US005083545A

United States Patent [19]

Yamashita et al.

[11] Patent Number: 5,083,545

[45] Date of Patent: Jan. 28, 1992

[54] DIESEL ENGINE WITH MECHANICAL GOVERNOR

[75] Inventors: Kenji Yamashita; Tatsuyuki Nakamura; Shinji Sasaki, all of Sakai, Japan

[73] Assignee: Kubota Corporation, Osaka, Japan

[21] Appl. No.: 577,772

[22] Filed: Sep. 5, 1990

[30] Foreign Application Priority Data

Sep. 12, 1989 [JP] Japan ..... 1-237005
Sep. 21, 1989 [JP] Japan ..... 1-247201
Sep. 21, 1989 [JP] Japan ..... 1-247202

[51] Int. Cl.[5] ..... F02M 37/04

[52] U.S. Cl. ..... 123/509; 123/373; 123/195 R

[58] Field of Search ..... 123/509, 373, 495, 195 R, 123/198 C, 198 E

[56] References Cited

U.S. PATENT DOCUMENTS 3,730,147 5/1973 Buchwald ..... 123/41.44
4,023,547 5/1977 Reisacher ..... 123/195 R
4,403,586 9/1983 Taniguchi ..... 123/509
4,412,513 11/1983 Obermayer et al. ..... 123/509
4,480,609 11/1984 Hayashi ..... 123/195 C
4,607,601 8/1986 Kohler ..... 123/196 R
4,831,984 5/1989 Takahashi ..... 123/373

FOREIGN PATENT DOCUMENTS 55-51086 12/1980 Japan .
63-14031 4/1988 Japan .
0224411 9/1989 Japan ..... 123/195 C

*Primary Examiner*—E. Rollins Cross
*Assistant Examiner*—Thomas N. Moulis
*Attorney, Agent, or Firm*—Bacon & Thomas

[57] ABSTRACT

In a diesel engine, a cylinder block has a pump housing integratedly provided for a fuel injection pump unit at the lateral side thereof. A timing transmission case is fixedly secured to the fore portions of the cylinder block and the pump housing. A governor weight of a mechanical governor and a transmission member for transmitting a centrifugal force of the governor weight are supported by a fuel injection camshaft within the pump housing. A governor lever and a governor spring are disposed within the pump housing in such a condition as not entering the timing transmission case.

13 Claims, 8 Drawing Sheets

DIESEL ENGINE WITH MECHANICAL GOVERNOR

BACKGROUND OF THE INVENTION

1. Field of the Invention

The present invention relates to a diesel engine with a mechanical governor, and pertains to a technology for providing an ultra small diesel engine.

2. Prior Art

As a diesel engine with a mechanical governor, for example as shown in FIG. 10 or FIG. 11, has been known the one having a following basic construction. Incidentally, the arrow F and the arrow B in Figs. indicate the fore side and the back side of the engine respectively.

That is, in a lateral side portion of a cylinder block 203, 403 there is provided a pump housing 244, 444 of a fuel injection pump unit 243, 443, integrally formed with the cylinder block 203, 403. In the pump housing 244, 444 there are provided a fuel injection pump 245, 445 and a fuel injection cam shaft 246, 446. A timing transmission case 249, 449 is fixedly secured to the front portions of the cylinder block 203, 403 and the pump housing 244, 444. Within the timing transmission case 249, 449, the fuel injection cam shaft 246, 446 is interlockingly connected to a crankshaft through a timing transmission device 250, 450. A governor spring 329, 529 and a governor weight 340, 540 are interacted with a rack pin 299, 499 of a control rack of the fuel injection pump 245, 445 through a governor lever 315, 515 of a mechanical governor 247, 447.

In the above-mentioned basic construction, a conventional arrangement of the mechanical governor is disclosed in Japanese Utility Model Publication No. 1988-14031 (referred to as a first conventional embodiment hereinafter) and Japanese Patent Publication No. 1980-51086 (referred to as a second conventional embodiment hereinafter.

FIRST CONVENTIONAL EMBODIMENT

As shown in FIG. 10, the governor weight 340 and a governor sleeve 341 formed as a centrifugal force transmission member are supported by a weight driving shaft 349 underneath the fuel injection cam shaft 246, a weight driving shaft input gear 350 is interlockingly connected to a fuel injection cam shaft input gear 253, and the fore end portion of the governor lever 315 is introduced into the interior of the timing transmission case 249.

There are, however, the following problems (1)~(3) associated with the aforementioned first conventional embodiment.

(1) The construction of the engine is complicated.

Since the weight driving shaft 349, the weight driving shaft input gear 350 and bearings 376, 377 are required for the drive of the governor weight 340, the construction of the engine becomes complicated. Therefore, the engine is high in manufacturing cost and troublesome in maintenance.

(2) The engine is large in length in the fore and back direction.

Since the input gear 253 is required to be located at a forward remote position in order to avoid the interference between the fore end portion of the governor lever 315 and the peripheral portion of the cam shaft input gear 253, the timing transmission case 249 projects forward and accordingly the total length of the engine becomes longer by that remotion.

(3) The engine is low in durability.

Since the cam shaft input gear 253 is located at the forward remote position, the distance between a bearing 291 disposed in the front wall of the pump housing 244 and the gear 253 becomes longer by that remotion. Therefore, a bending moment acted on the bearing 291 and the fuel injection cam shaft 246 by the gear 253 becomes large. Resultantly, the cam shaft 246 and the bearing 291 are apt to be worn and the durability of the engine becomes low.

SECOND CONVENTIONAL EMBODIMENT

As shown in FIG. 11, the governor weight 540 and a governor sleeve 541 provided as a centrifugal force transmission member are supported by the fuel injection cam shaft 446. The governor weight 540 and the governor sleeve 541 are disposed behind a fuel injection cam shaft input gear 453, and a governor lever 515 and most of the governor spring 529 are disposed within the timing transmission case 449.

According to this second conventional embodiment, since the weight driving shaft 349 and the like employed in the first conventional embodiment are omitted herein, advantageously the aforementioned problem of the item (1) can be solved so as to simplify the engine construction.

However, in this second conventional embodiment, since the cam shaft input gear 453 is largely remote from the front wall of the pump housing 444, a distance between a bearing 491 and the gear 453 becomes larger. Therefore, the problems in the items (2) and (3) of the first conventional embodiment appear as conspicuous bad results.

SUMMARY OF THE INVENTION

It is an object of the invention to solve all the problems of the aforementioned items (1)~(3), namely to simplify the construction of the engine, to shorten the length of the engine in the fore and back direction so as to make the engine compact and to improve the durability of the engine.

For accomplishing the above object, the aforementioned basic construction is improved by the present invention as follows.

That is, the governor weight and the transmission member for transmitting the centrifugal force of the governor weight are supported by the fuel injection camshaft within the pump housing. The governor lever and the governor spring are disposed within the pump housing in such a condition as not entering the timing transmission case.

Since the present invention is constructed as mentioned above, the following advantages can be provided.

(1) The construction of the engine is simplified.

By making use of the fuel injection camshaft also as the weight driving shaft and by making use of the fuel injection cam shaft input wheel means also as the weight driving shaft input wheel means, the weight driving shaft, the weight driving input gear and the weight driving shaft bearings employed in the first conventional embodiment (refer to FIG. 10) can be omitted. Therefore, the construction of the engine can be simplified, the manufacturing cost of the engine can be reduced as well as the maintenance thereof can be readily carried out.

(2) The length of the engine in the fore and back direction can be shortened.

By avoiding the interference between the peripheral portion of the fuel injection cam shaft input wheel means and the governor lever as well as the governor spring, the input wheel means can be disposed near the front wall of the pump housing. Thereby, the thickness dimension of the timing transmission case in the fore and back direction becomes small, and the total length of the engine can be shortened by that so as to manufacture the compact engine.

(3) The durability of the engine can be improved.

Since the fuel injection camshaft input wheel means can be disposed near the front wall of the pump housing, the distance between the fore bearing and the input wheel means of the fuel injection camshaft can be shortened. Thereby, the bending moment acted on the camshaft and the bearing by the input wheel means becomes small. Resultantly, the wear-outs of the camshaft and the bearing can be restrained so that the durability of the engine can be improved.

BRIEF DESCRIPTION OF THE DRAWINGS

Further characteristics and advantages of the present invention will become apparent from the detailed description of one embodiment, illustrated only by way of non-limitative example in the accompanying drawings, wherein;

FIG. 1 is a perspective view of a diesel engine;

FIG. 2 is a front view of the engine under the condition that a radiator fan and a timing transmission case are removed from the engine body;

FIG. 3 is a right side view of the engine;

FIG. 4 is a sectional view taken along the IV—IV directed line in FIG. 1;

FIG. 5 is a sectional view taken along the V—V directed line in FIG. 1;

FIG. 6 is a sectional view taken along the VI—VI directed line in FIG. 1;

FIG. 7 is a partial sectional view taken as a plan from FIG. 6;

FIG. 8 is a sectional view taken along the VIII—VIII directed line in FIG. 6;

FIG. 9 is a schematic view of FIG. 6;

DESCRIPTION OF THE PREFERRED EMBODIMENT

Figure 1:
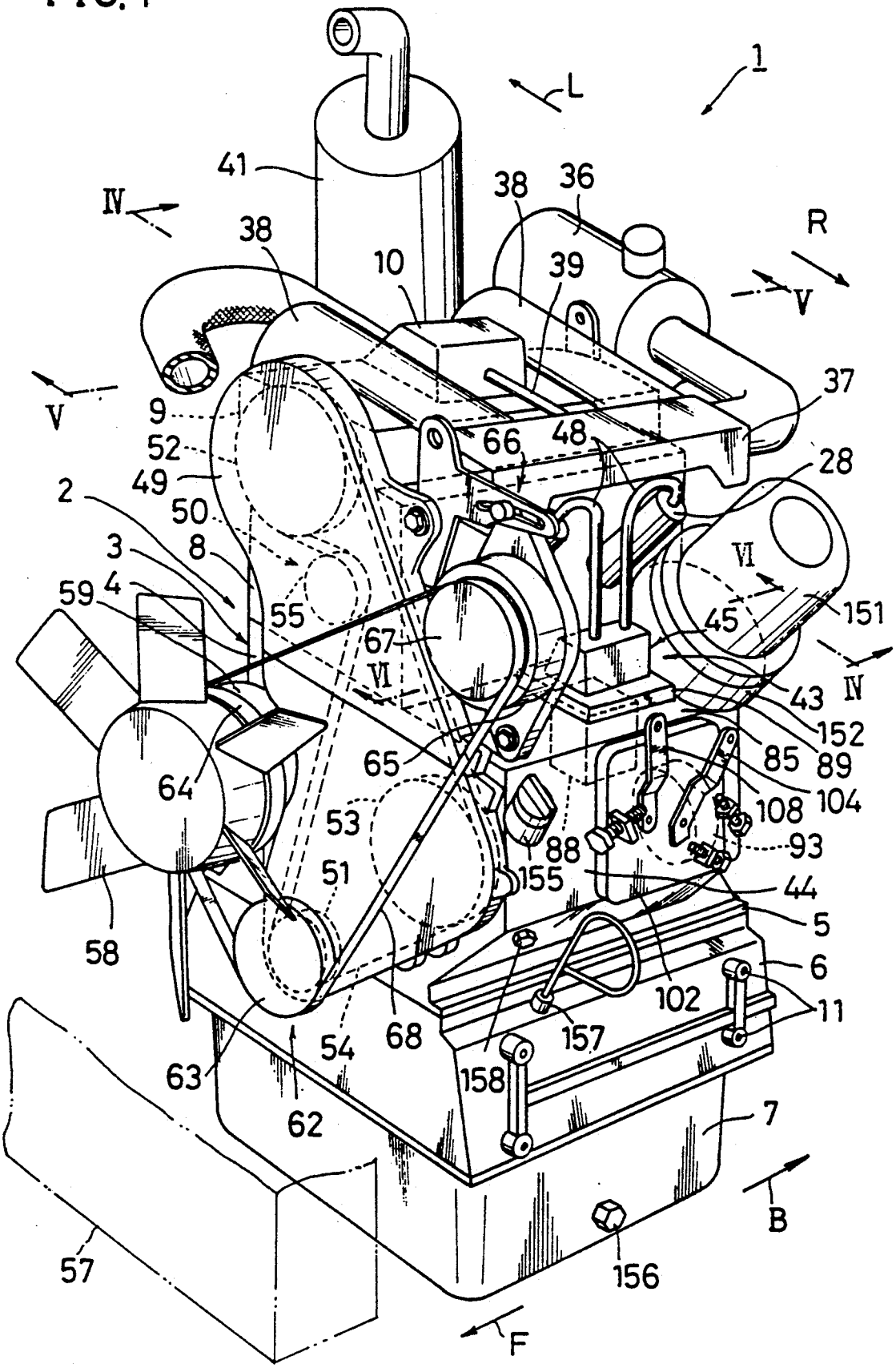
FIGS. 1 through 9 show one embodiment of the present invention.

Now, one embodiment of the present invention will be explained with reference to FIGS. 1 through 9 hereinafter. An engine of this embodiment has been manufactured by way of trial in order to provide an ultra small diesel engine. The engine is of the vertical liquid-cooled overhead camshaft type and has the total stroke volume of 300 cc composed of two combustion chambers of 150 cc. Incidentally, the output of the diesel engine is set at 9 h.p./4500 rpm.

Firstly, with reference to FIGS. 1 through 5, the whole construction of the diesel engine 1 will be explained. In each figure, the forward and the backward of the engine are indicated by the arrow F and the arrow B respectively, and the leftward and the rightward thereof are indicated by the arrow L and the arrow R respectively.

A cylinder block 3 of an engine body 2 comprises a cylinder portion 4 and an upper crankcase 5 integrally formed up and down. A lower crankcase 6 and an oil pan 7 are fixedly secured in order to the lower portion of the cylinder block 3. A cylinder head 8 and a head cover 9 are fixedly secured in order to the upper portion of the cylinder block 3. A breather chamber 10 is projected upward from the central portion of the head cover 9. The engine body 2 is adapted to be mounted to an engine working machine such as an engine generator and the like through four threaded holes 11 (refer to FIG. 1) formed in both the left and right sides of the lower crankcase 6 respectively.

Figure 4:
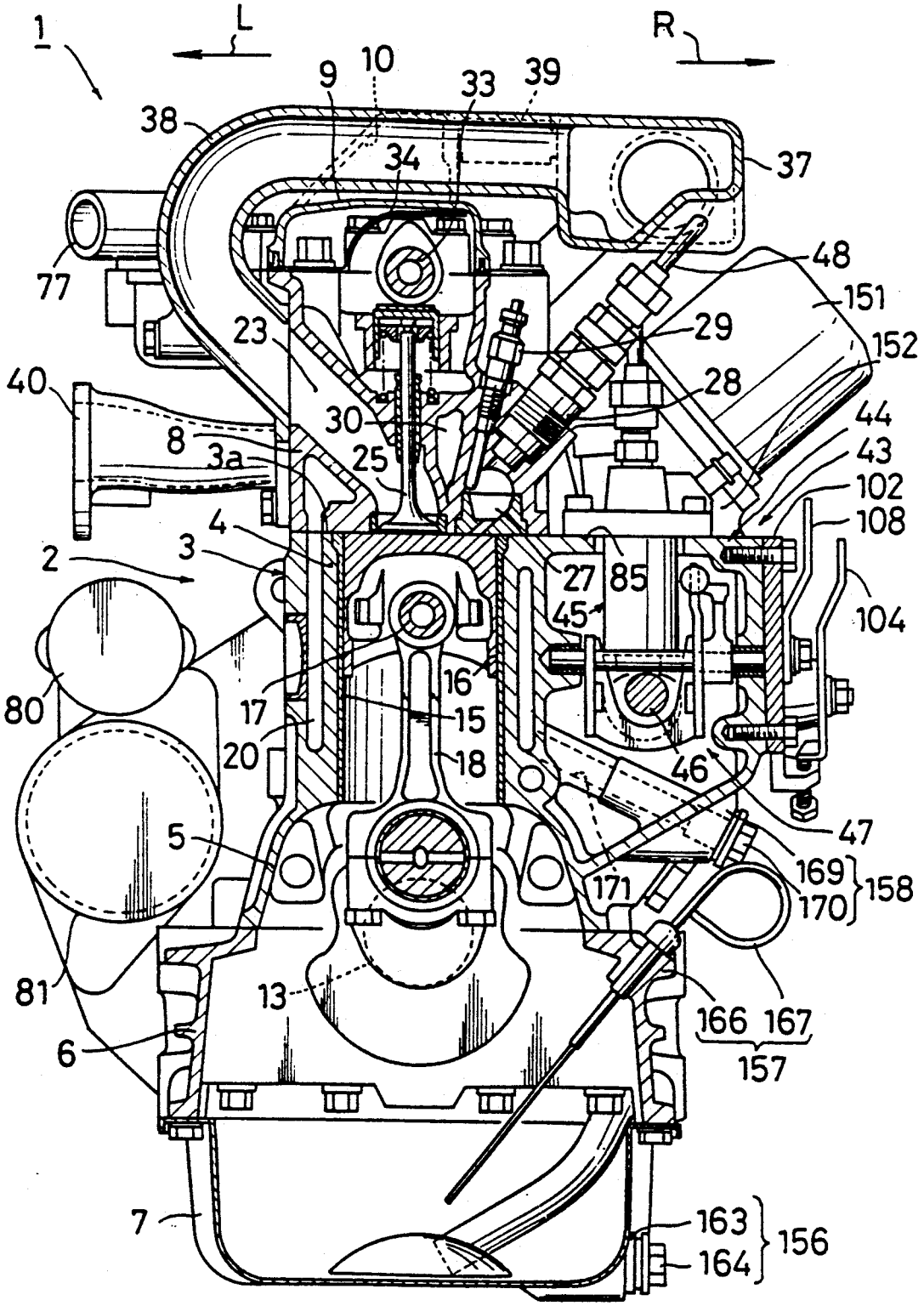
Figure 5:
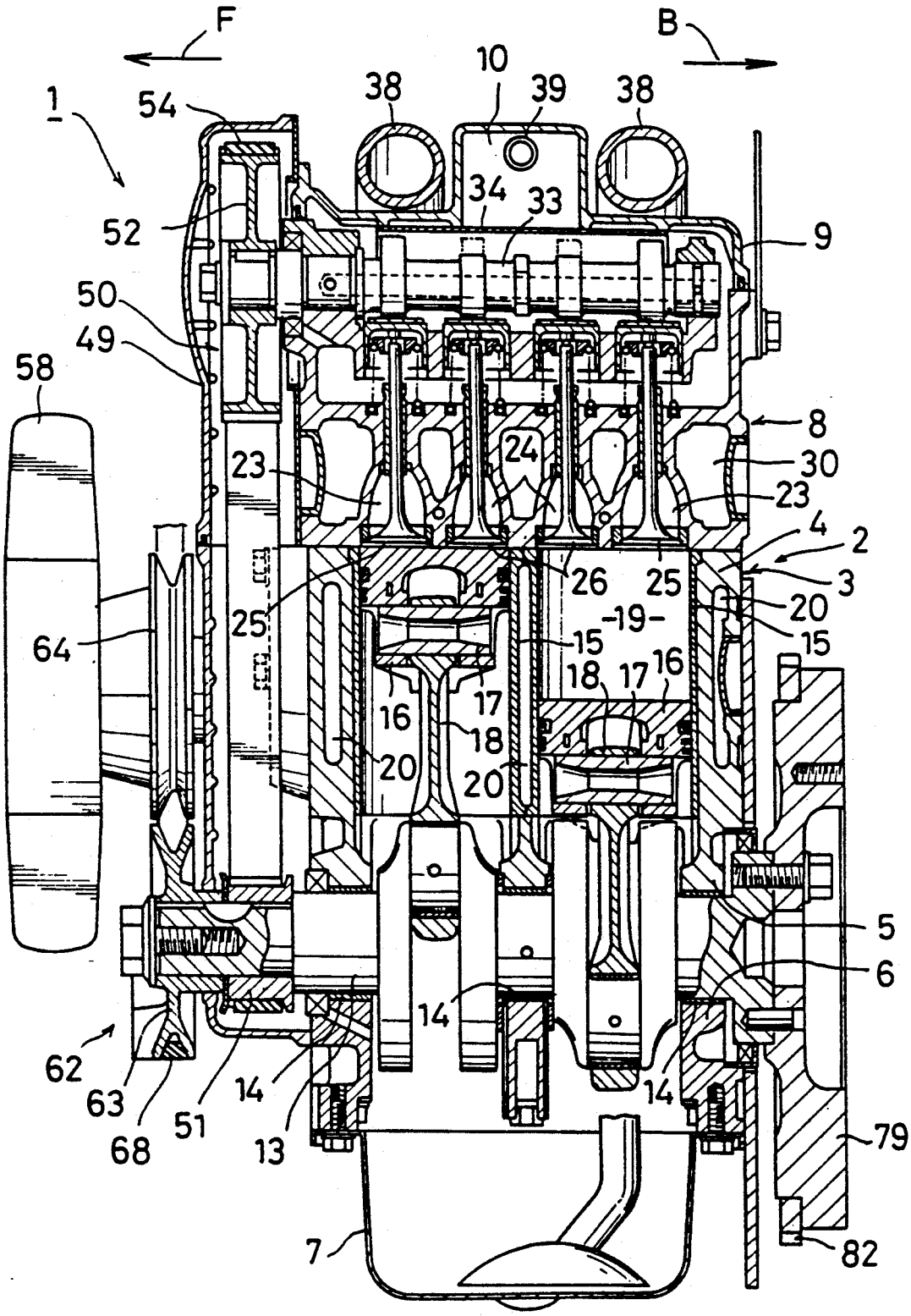

As shown mainly in FIGS. 4 and 5, a crankshaft 13 is disposed between the upper crankcase 5 and the lower crankcase 6 so as to extend in the fore and back direction and rotatably supported by a plurality of bearings 14. A piston 16 is slidably inserted into each of two cylinders 15 of the cylinder portion 4. A piston pin 17 of each piston 16 is connected to the crankshaft 13 through a connecting rod 18. A combustion chamber 19 is disposed above each piston 16, and a cylinder jacket 20 is disposed around each cylinder 15.

The cylinder head 8 has intake valves 25, 25 mounted at intake ports 23, 23 and exhaust valves 26, 26 mounted at exhaust ports 24, 24, and further has a fuel injection nozzle 28 and a glow plug 29 mounted in a divided combustion chamber 27 and a head jacket 30 formed around the ports 23, 24. Two fuel injection nozzles 28, 28 are mounted to the right wall portion of the cylinder head 8 symmetrically with respect to the fore and back directed center line (refer to FIGS. 1 and 3).

A valve actuating camshaft 33 is supported between the cylinder head 8 and the head cover 9 so as to extend in the fore and back direction. A partition plate 34 disposed above the camshaft 33 serves to prevent lubricating oils scattered within the cylinder head 8 and the head cover 9 from entering the breather chamber 10.

An intake air for the engine is introduced from an air cleaner 36 disposed behind the cylinder head 8 into the intake ports 23, 23 through a surge tank 37 disposed on the right upper side of the head cover 9 so as to extend in the fore and back direction and intake pipes 38, 38 disposed both on the foreside and on the backside of the breather chamber 10 in order. The surge tank 37 is so constructed as to function as a resonance intake silencer. The breather chamber 10 is intercommunicated with the surge tank 37 through a breather pipe 39. An exhaust gas of the engine is discharged outside from the respective exhaust ports 24, 24 through an exhaust manifold 40 (refer to FIG. 4) and an exhaust muffler 41 (refer to FIG. 4) disposed on the left back side of the engine body 2 in order.

A fuel injection pump unit 43 has a pump housing 44 integrally formed with the cylinder portion 4 on the right lateral side of the cylinder block 3. A fuel injection pump 45, a fuel injection camshaft 46 and a mechanical governor 47 are mounted in a fore portion of the pump housing 44. The fuel injection pump 45 is disposed substantially at the central portion of the cylinder block 3 in the fore and back direction and mounted in a back-half portion of pump housing 44. Thereby, two injection pipes 48, 48 which connects each pump element (not illustrated) within the pump 45 to each fuel injection nozzle 28 are arranged symmetrically in a short piping length. The fuel injection camshaft 46 is disposed in the space below the pump 45 so as to extend in the fore and back direction.

A timing transmission case 49 is fixedly secured to the fore portions of the cylinder block 3 and the pump housing 44. Within this case 49, a toothed belt transmission type timing transmission device 50 is disposed. That is, a timing output pulley 51, a valve actuating input pulley 52 and a fuel injection camshaft input pulley (input wheel means) 53 are fixedly secured to each fore end portion of the crankshaft 13, the valve actuating camshaft 33 and the fuel injection camshaft 46 respectively. A toothed belt 54 is wrapped around these pulleys 51, 52, 53. By the way, a tension pulley 55 is disposed between the output pulley 51 and the valve actuating input pulley 52.

A radiator 57 (indicated by an alternate long and two short dashes line in FIG. 1) is disposed in the space in front of the engine body 2 having the above-mentioned construction. A radiator fan 58 is connected to the fore end portion of a pump shaft 60 (refer to FIG. 2) of an engine cooling liquid circulation pump 59 fixedly secured on the left upper portion of the cylinder block 3.

Figure 2:
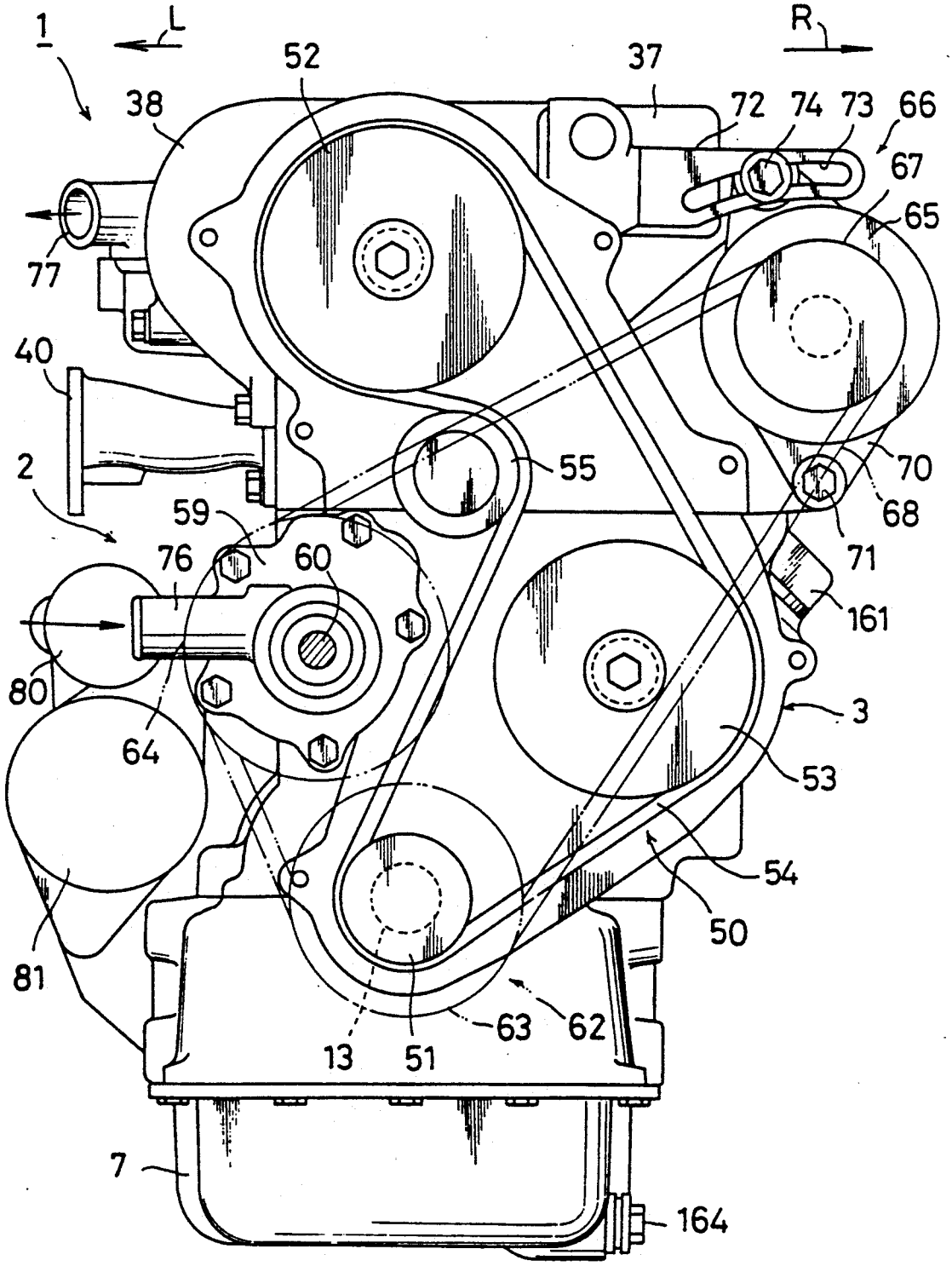
Figure 3:
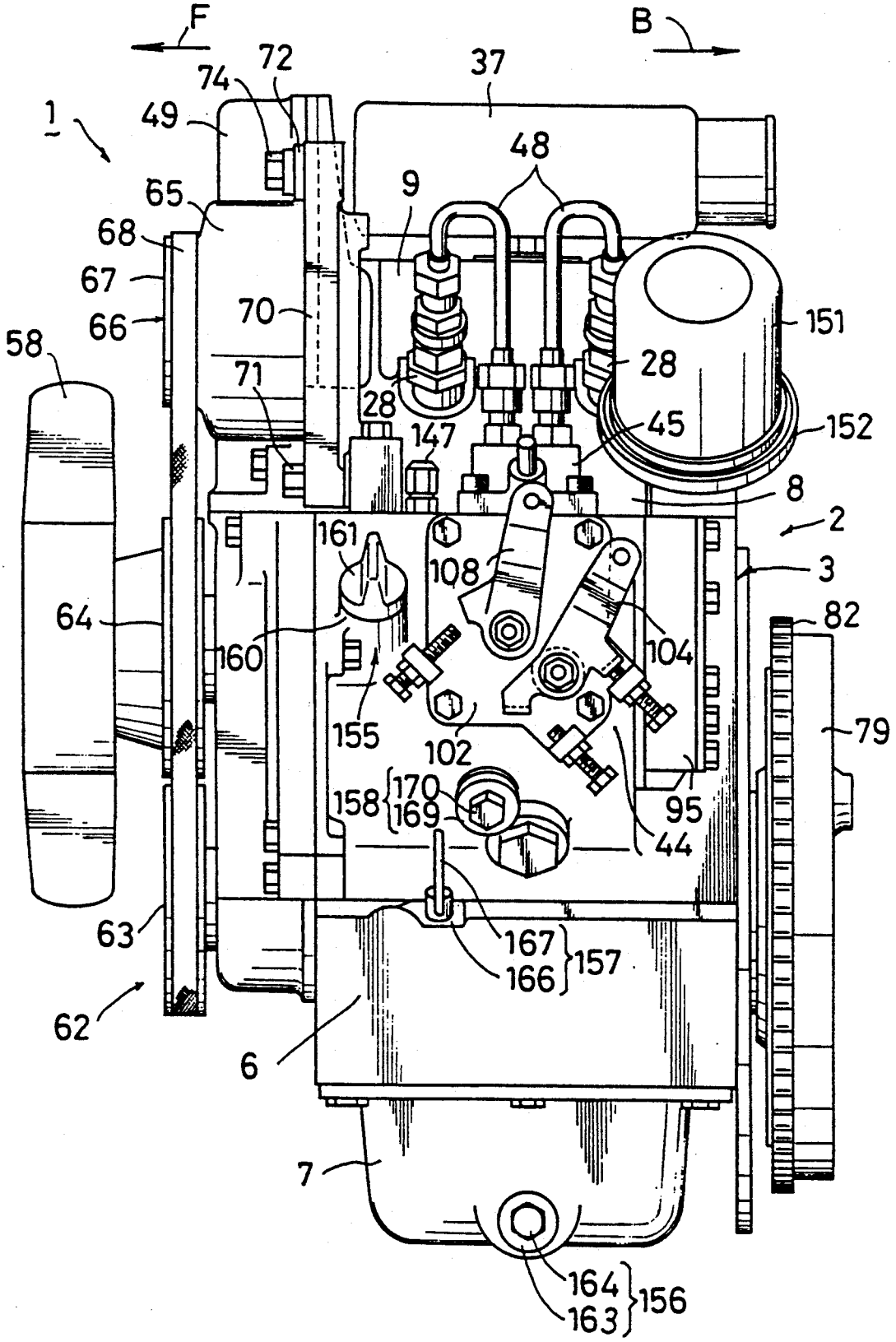

In order to drive engine attachments such as the aforementioned fan 58, the pump 59 and the like, a belt transmission device 62 is arranged in the front space outside the timing transmission case 49. That is, an engine attachment driving output pulley 63 is fixedly secured to the fore end portion of the crankshaft 13 in front of the timing output pulley 51. A fan input pulley 64 is fixedly secured to the back portion of the radiator fan 58, and a tension pulley 67 as a belt tension means 66 is fixedly secured to a dynamo 65 disposed at the right upper position of the timing transmission case 49. A V-transmission belt 68 is wrapped around these pulleys 63, 64, 67. The belt tension means 66 is disposed in the fore space above the fuel injection pump 45 and on the right lateral side of the cylinder head 8 so as to be constructed as shown in FIG. 2. A dynamo base plate 70 is pivotally supported at its lower portion by the engine body 2 through a lower bolt 71. A bracket 72 is fixedly secured to the upper portion of the engine body 2. The base plate 70 is fixedly secure at its upper portion to the bracket 72 so as to be pivotally adjustable by means of an upper bolt 74 inserted into a guide groove 73 of the bracket 72.

When the circulation pump 59 is driven, the engine cooling liquid is circulated as follows. Mainly as shown in FIG. 2, the engine cooling liquid passes through an inlet nozzle 76 of the circulation pump 59, the cylinder jacket 20 and the head jacket 30 in order from the lower portion of the radiator 57 and then returns to the upper portion of the radiator 57 from an outlet nozzle 77 provided at the left upper portion of the cylinder head 8. The cooling liquid is air-cooled by means of the fan 58 during the downward flowing thereof within the radiator 57.

A flywheel 79 is fixedly secured to the output portion of the crankshaft 13 at the back end. A starter 80 and a starter motor 81 is fixedly secured to the left back portion of the engine body 2, and an output pinion of the starter 80 at the back end is adapted to be engaged with a ring gear 82 of the fly wheel 79.

Figure 7:
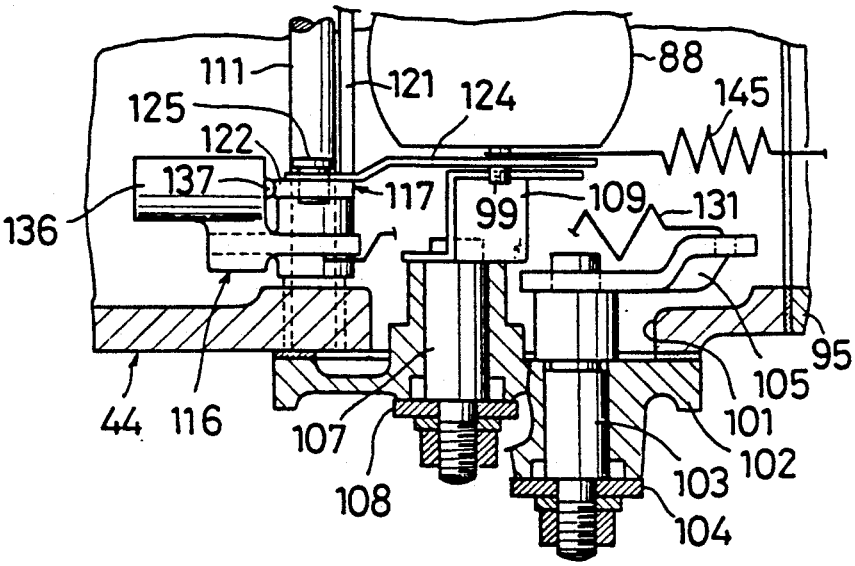
Figure 6:
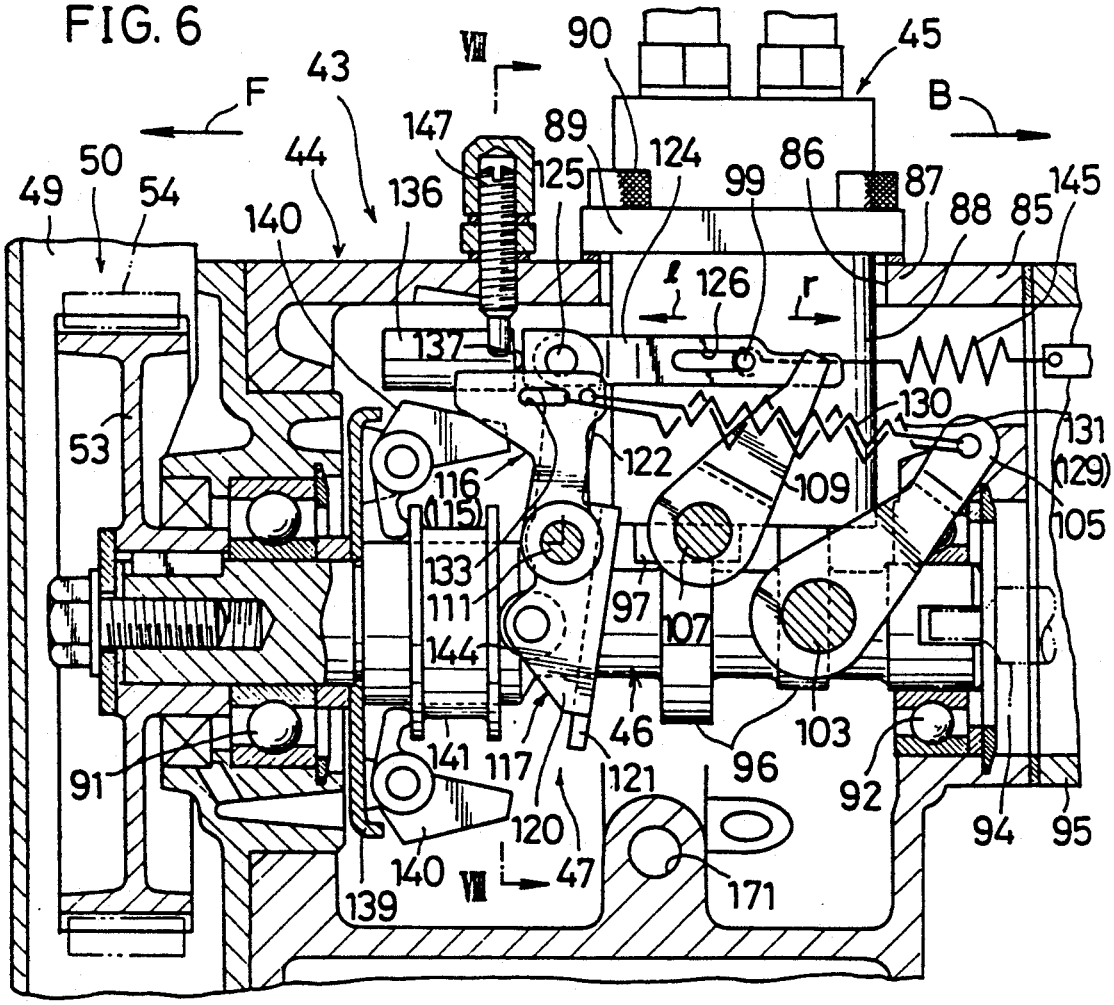
Figure 8:
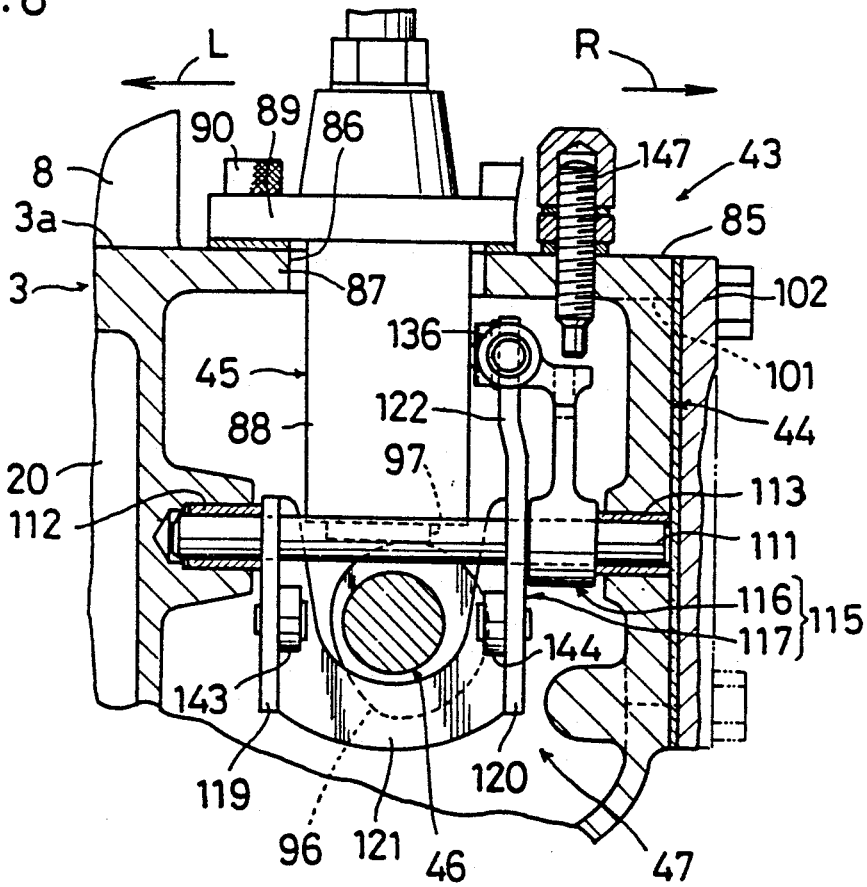

Then, the concrete constructions of the fuel injection pump 45, the fuel injection camshaft 46 and a mechanical governor 47 will be explained with reference to FIGS. 6 through 8.

A pump mounting bore 86 and a pump receiving seat 87 for mounting the fuel injection pump 45 are formed in an upper wall 85 of the pump housing 44. The upper surface of the pump receiving seat 87 is so formed as to be about at the same level as a cylinder head receiving surface 3*a* provided in the upper surface of the cylinder block 3. The fuel injection pump 45 is so constructed as to be mounted through its flange and has a trunk portion 88 and a mounting flange portion 89 arranged in order from below. The trunk portion 88 is inserted into the pump housing 44 through the pump mounting bore 86 from above, and the mounting flange 89 is brought into contact with the upper surface of the pump receiving seat 87 from above and fixedly secured to the housing upper wall 85 by a plurality of bolts 90.

The fuel injection camshaft 46 is rotatably supported by the pump housing 44 through fore and back bearings 91, 92. The aforementioned fuel injection camshaft input pulley 53 is fixedly secured to the fore end portion of the camshaft 46, and a pump shaft 94 of a lubricating oil pump 93 (refer to FIG. 1) is connected to the back end portion of the camshaft 46. The aforementioned timing transmission case 49 is fixedly secured to the fore portion of the pump housing 44 so as to cover the input pulley 53 and the toothed belt 54. A pump casing 95 is fixedly secured to the back portion of the pump housing 44 so as to cover an oil pump 93. Two fuel injection cams 96, 96 are disposed in the back portion of the camshaft 46, and each pump element (not illustrated) of the fuel injection pump 45 is driven by means of each cam 96 through each tappet 97.

A mechanical governor 47 is interlocked to a rack pin 99 provided in a fuel quantity adjusting means of the aforementioned fuel injection pump 45 so that the injection quantity of the pump 45 can be controlled to keep an engine revolution at a set value even though an engine load changes. The arrow l in FIG. 6 indicates a fuel quantity decreasing direction and the arrow r therein indicates a fuel quantity increasing direction.

The mechanical governor 47 will be explained with reference to a schematic view of FIG. 9 in addition to FIGS. 6 through 8.

A governor mounting port 101 is formed in the right wall of the pump housing 44, and this mounting port 101 is covered with a cover plate 102. A speed control lever 104 (refer to FIGS. 3 and 4) is fixedly secured to an outer end of one pin 103 passed through the back portion of the cover plate 102, and a control swivel member 105 is fixedly secured to the inner end of the pin 103. A stopper lever 108 (refer to FIGS. 3 and 4) is fixedly secured to an outer end of the other pin 107 passed through the fore portion of the cover plate 102, and a stopper swivel member 109 is fixedly secured to an inner end of the pin 107.

A governor pivot pin 111 is supported by both the left and the right walls of the pump housing 44 through left and right bearings 112, 113. The governor lever 115 supported by the pivot pin 111 comprises a spring lever 116 and a rack lever 117. The spring lever 116 is swingably supported at its lower portion by the right portion of the pivot pin 111. The rack lever 117 comprises swingable plates 119, 120 supported by the pivot pin 111 at the left and right opposite sides of the fuel injection camshaft 46, a connection plate 121 provided between both these plates 119, 120 and a lever portion 122 projected upward from the right swingable plate 120. The upper end of the lever portion 122 and the rack pin 99 of the fuel quantity adjusting means are connected by means of a control link 124. The fore end of the control link 124 is connected to the upper end of the lever portion 122 through the pin 125, and the rack pin 99 is fitted into a slot 126 of the control link 124 so as to be freely movable in the fore and back direction.

A governor spring 129 mounted between the upper end of the spring lever 116 and the upper end of the control swivel member 105 comprises a low revolution speed spring 130 and a high revolution speed spring 131. The fore end of the high revolution speed spring 131 is inserted into a slot 133 of the spring lever 116.

Further, a spring case 136 of a torque spring 135 (refer to FIG. 9) is fixedly secured to the upper end of the spring lever 116. The resilient force of the governor spring 129 serves to swingably urge the rack lever 117 in the fuel quantity increasing direction r through spring lever 116, the torque spring 135 within the spring case 136 and a pushing pin 137. A plurality of governor weights 140 are supported by the fore portion of the fuel injection camshaft 46 through a bracket 139, and a governor sleeve 141 as a centrifugal force transmission member is fitted around the fore portion thereof so as to be movable in the fore and back direction. The centrifugal force of the governor weight 140 is transmitted to respective rollers 143, 144 of the respective swingable plates 119, 120 through the governor sleeve 141 so as to swingably drive the rack lever 117 in the fuel quantity decreasing direction l. According to a balance between the resilient force of the governor spring 129 and the centrifugal force of the governor weight 140, the rack pin 99 is adapted to be controlled in the fore and back direction so as to keep the engine revolution at a predetermined valve set by the speed control lever 104.

The afore mentioned rack pin 99 is resiliently urged in the fuel quantity increasing direction r by means of a start spring 145. Further, a fuel limiting member 147 composed of a bolt is vertically passed through the upper wall 85 of the pump housing 44 so as to be oil-tightly and adjustably advanced and retracted. The fuel limiting member 147 is adapted to be brought into stop contact with the spring lever 116 at a full load position D (refer to FIG. 9).

The operation of the aforementioned mechanical governor 47 having the above-mentioned construction will be explained with reference to FIG. 9.

As illustrated, when the speed control lever 104 is set at the high revolution speed, the rack pin 99 is adapted to be controlled within a fuel control region between the 0/4 load position A and the 4/4 load position (the full load position) D according to a balance between the governor weight centrifugal force W and the resultant force of a resilient force M of the low revolution speed spring 130 and a resilient force N of the high revolution speed spring 131. Thereby, the engine speed is kept at the predetermined high revolution speed though the engine load changes.

When an overload is applied to the engine running at the aforementioned high revolution speed, the governor weight centrifugal force W is rapidly decreased and the spring lever 116 is swingably driven in the fuel quantity increasing direction r by means of the spring resilient force M or the resultant force of the resilient forces M, N. But, when the engine reaches the 4/4 load position D due to the movement of the rack pin 99 in the fuel quantity increasing direction r, the spring lever 116 is stopped by means of the fuel limiting member 147 so as be prevented from further swinging beyond that position. Therefore, it becomes impossible to transmit the spring force M or N to the rack lever 117. Owing to that, the rack lever 117 is swung in the fuel increasing direction r by means of the resilient force of only the torque spring 135 so that the engine running at the high revolution speed can secure a tenacious operation.

The function of the aforementioned torque spring 135 will be explained in greater detail. The spring constant of the torque spring 135 is set at a smaller value than the respective spring constants of both the aforementioned governor springs 130, 131. Therefore, when an overload is applied to the engine, the moving speed of the rack pin 99 in the fuel quantity increasing direction r with respect to a variation of the centrifugal force W of the governor weight 140 is adapted to be slowed during a duration for the rack pin 99 to reach an overload position E after having gone over the 4/4 load position D rather than a duration for the rack pin 99 to reach the 4/4 load position D. Therefore, when the overload is applied, a transit duration to an engine stall can be kept long by slowly lowering the revolution speed of the engine. As a result, it becomes possible to secure a time margin for avoiding such an engine stall.

On one hand, when the speed control lever 104 is set at the low revolution speed, the fore end of the high revolution speed spring 131 is freely moved forward along the slot 133 of the spring lever 116 so that the resilient force N thereof doesn't act on the spring lever 116. According to the balance between the governor weight centrifugal force W and the weak resilient force M of only the low revolution speed spring 130, the rack pin 99 is controlled within the above-mentioned fuel control region so that the engine revolution speed can be kept at the predetermined low revolution speed.

Figure 9:
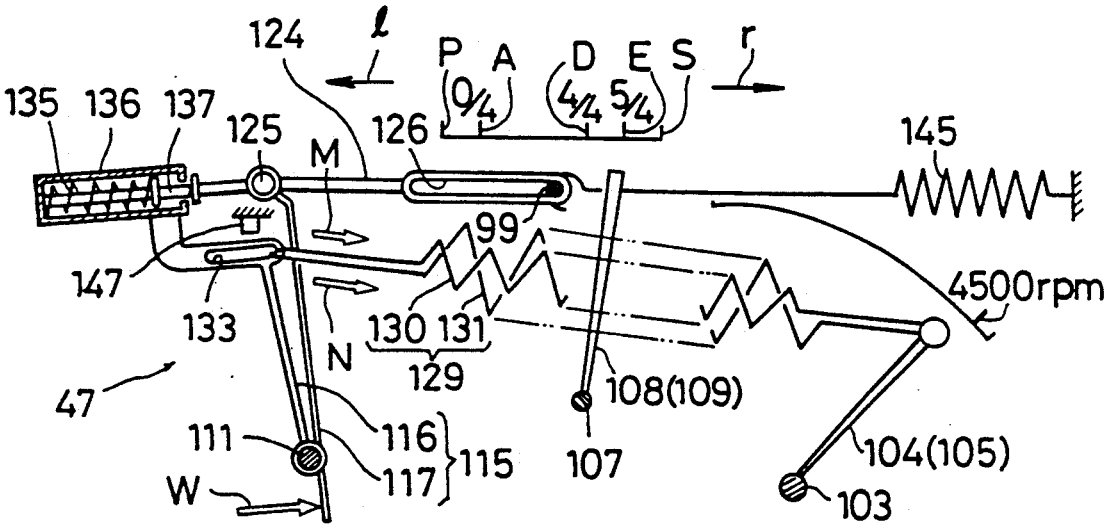

Incidentally, at the time of engine starting, the speed control lever 104 shall be operated to the rightmost position in FIG. 9. Then, the spring lever 116 is stopped by means of the fuel limiting member 147 as well as rack lever 117 is swung in the fuel quantity increasing direction r by means of the resilient force of the start spring 145 so that the rack pin 99 can be moved to a starting position S.

Further, at the time of engine stopping, a stop lever 108 shall be swung to the left side in FIG. 9. Thereby, the rack pin 99 is moved to a stop position P along the slot 126 of the control link 124. At the time of engine stopping operation, the stop lever 108 is not subject to a resistance provided by the resilient forces M, N of the governor springs 130, 131 but it is only subject to a resistance provided by the resilient force of the start spring 145. As a result, the engine stopping operation can be rapidly carried out.

On one hand, as shown in FIGS. 1 through 4, a lubricating oil filter 151 is disposed in the back portion of the space on the right lateral side of the cylinder head 8 and above the fuel injection pump 45. This filter 151 is fixedly secured to a filter mounting seat 152 fixedly mounted onto the back portion of the upper wall 85 of the pump housing 44.

A lubricating oil supply means 155 is disposed in the fore portion of the pump housing 44. A lubricating oil drain means 156 and a lubricating oil level check means 157 are arranged below the pump housing 44. An engine cooling-liquid drain means 158 is disposed in the lower portion thereof 44. The lubricating oil supply means 155 comprises a supply nozzle 160 and a supply cap 161 disposed in the upper portion of the cylinder block 3. The lubricating oil drain means 156 comprises a drain nozzle 163 and a plug 164 disposed in the lower portion of the oil pan 7. The lubricating oil level check means 157 comprises a gauge insertion nozzle 166 and a level gauge 167 disposed in the upper portion of the lower crankcase 6. The engine cooling-liquid drain means 158 comprises a drain nozzle 169 and a plug 170 disposed in the lower portion of the pump housing 44. The drain nozzle 169 is formed in the lower end portion of the drain port 171 (refer to FIGS. 4 and 6) bored through the lower portion of the pump housing 44 so as to be communicated with the lower portion of the cylinder jacket 20.

According to this embodiment, since the governor weight 140 and the governor sleeve 141 are supported by the fuel injection camshaft 46 within the pump housing 44 as well as the governor lever 115 and the governor spring 129 are so arranged as not to enter the timing transmission case 49, the following advantages mentioned in the items (1) through (3) can be provided.

(1) By making use of the fuel injection camshaft 46 also as the weight driving shaft as well as by making use of the input pulley 53 of the fuel injection camshaft input wheel means also as the weight driving shaft input wheel, the weight driving shaft 349, the weight driving shaft input gear 350 and the weight driving shaft bearings 376, 377 employed in the first conventional embodiment (refer to FIG. 10) can be omitted. Therefore, the engine construction can be simplified.

(2) By avoiding the interference between the peripheral portion of the fuel injection camshaft input pulley 53 and the governor lever 115 as well as the governor spring 129, it becomes possible to dispose the input pulley 53 near the front wall of the pump housing 44. Thereby, the thickness of the timing transmission case 49 in the fore and back direction can be made small and accordingly the total length of the engine can be shortened by that so as to allow the engine to be manufactured compact.

(3) Since the aforementioned input pulley 53 can be disposed near the front wall of the pump housing 44, the distance between the fore bearing 91 of the fuel injection camshaft 46 and the input pulley 53 can be shortened. Therefore, the bending moment acted on the camshaft 46 and the bearing 91 by the input pulley 53 becomes small. As a result, the wear-outs of the camshaft 46 and the bearing 91 can be restrained and the durability of the engine can be improved.

Further, since the fuel injection pump 45 is disposed about at the central portion of the cylinder block 3 in the fore and back direction, an advantage of the following item (4) can be provided.

(4) Since the injection pipes 48, 48 of the fuel injection pump 45 can be symmetrically arranged in a short piping distance (refer to FIGS. 1 through 3), the fuel injection pressure at the fuel injection nozzle 28 can be increased and the fuel injection delay can be restrained. As a result, the engine performance can be improved.

Further, since the upper surface of the pump mounting seat 87 is formed substantially at the same level as the cylinder head receiving surface 3*a* of the cylinder block 3 and the fuel injection pump 45 of the flange type is mounted onto the upper wall 85 of the pump housing 44 from above, advantages of the following items (5) and (6) can be provided.

(5) Since the fuel injection pump 45 is disposed near the fuel injection nozzle 28 so as to shorten the piping length of the injection pipe 48, the engine performance can be further improved.

(6) Since the fuel injection pump 45 is disposed in the upper portion of the cylinder block 3, a large space can be secured below the pump housing 44 so as to be utilized as a maintenance space.

Since the timing transmission device 50 is constructed as the belt transmission type one, an advantage of the following item (7) can be provided.

(7) The dimensional accuracy between the crankshaft 13 and the fuel injection camshaft 46 can be made loose and the manufacturing cost of the engine can be reduced.

Figure 10:
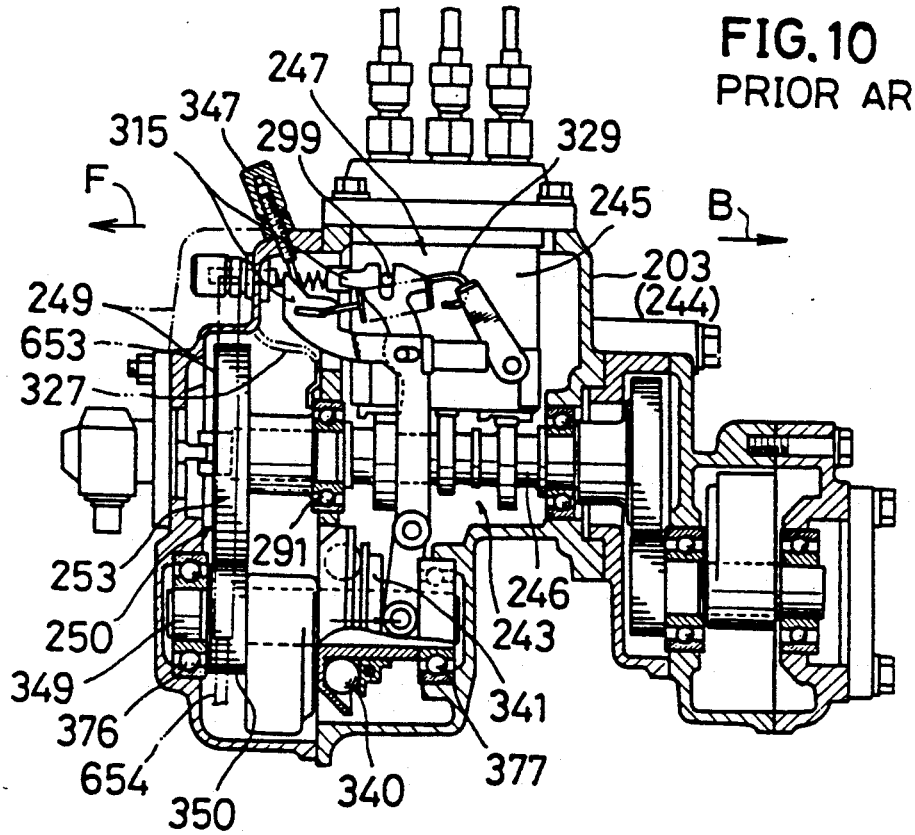
FIG. 10 PRIOR ART
FIG. 10 is a view showing a first conventional embodiment corresponding to FIG. 6.
Figure 11:
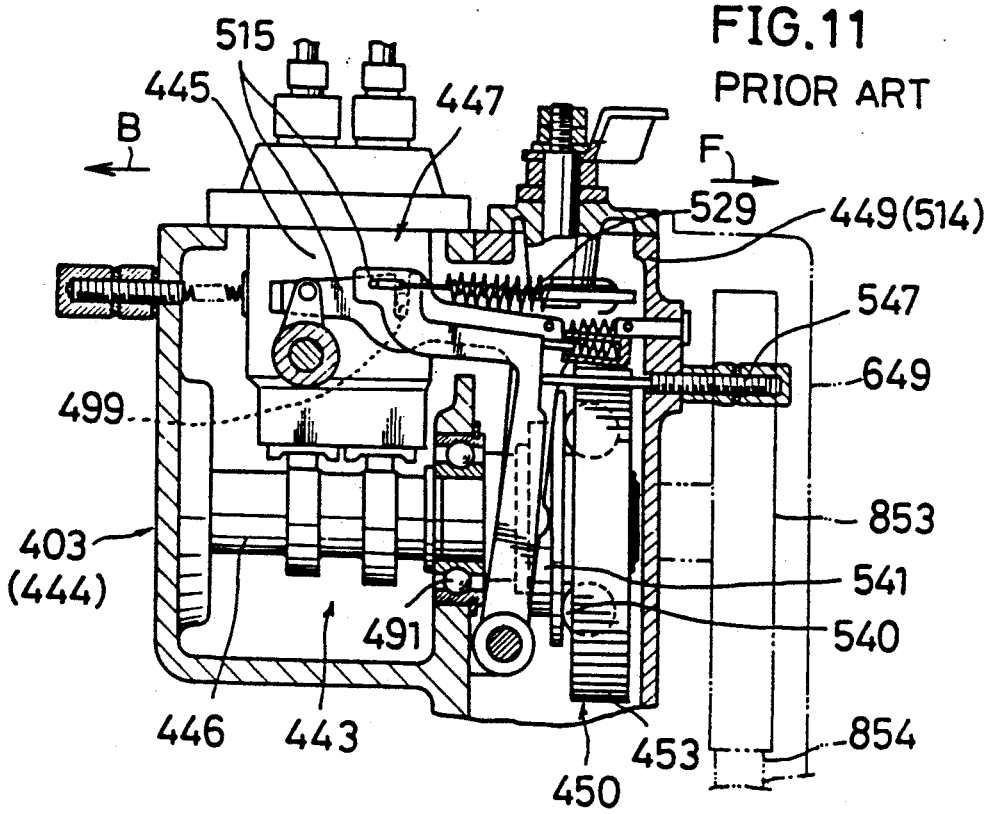
FIG. 11 PRIOR ART
FIG. 11 is a view showing a second conventional embodiment corresponding to FIG. 6.

Incidentally, in the case that the timing transmission device 250, 450 employed in the first conventional embodiment and the second conventional embodiment is modified from the gear type one to the belt transmission type one, it is necessary to construct as indicated by the alternate long and two short dashes line in FIG. 10 or in FIG. 11. That is, in order to decrease a load per unit area of the timing belt, it is necessary to make the fuel injection camshaft pulley 653, 853 larger than the gear 253, 453 in diameter. Further, in order to prevent a lowering of a strength of the timing belt 654, 854 caused by an oil infiltration, it is necessary to provide a sealing between the mechanical governor 247, 447 and the timing transmission device 250, 450.

In a first trial example indicated by the alternate long and two short dashes line in FIG. 11, in order to avoid the interference between a fuel injection camshaft input pulley 853 having a large diameter and a governor 447 as well as to prevent a lubricating oil around the governor 447 from being scattered to a timing belt 854, a governor case 514 can't help being remained between a pump housing 444 and a timing transmission case 649 so as to dispose a governor lever 515, a governor spring 529 and a governor weight 540 within a governor case 514. In this case, a fuel limiting member 547 is covered with the timing transmission case 649.

There are, however, the following problems associated with the first trial example. Since the governor case 514 and the timing transmission case 649 are disposed in front of the pump housing 444, the total length of the engine becomes long. Further, since it is necessary to doubly mount the governor case 514 and the timing transmission case 649 to the pump housing 444, the manufacturing cost becomes high. Furthermore, since the fuel limiting member 547 is adapted to be adjusted after the removal of the timing transmission case 649, the adjusting work is troublesome.

On one hand, similarly to the aforementioned first trial example, also in a second trial example indicated by the alternate long and two short dashes line in FIG. 10, it is necessary to dispose the fuel injection camshaft input pulley 653 in front of a fuel limiting member 347 in order to avoid the interference between the input pulley 653 and the fuel limiting member 347 disposed within the timing transmission case 249.

Accordingly, there are the following problems associated with the second trial example.

Since it is necessary to dispose the fuel injection camshaft input pulley 653 and the timing belt 654 away from the fuel limiting member 347, the thickness dimension of the timing transmission case 249 becomes large and the total length of the engine becomes long. Further, since it is necessary to provide a partition wall 327 within a timing transmission case 249 in order to prevent the lubricating oil from entering the timing transmission case 249 from the governor lever 315, the manufacturing cost of the engine becomes high and it takes much labor for the maintenance thereof.

Contrary to these first and second trial examples, according to the present invention, advantages of the following items (8) through (11) can be provided.

(8) Since only the timing transmission case 49 is disposed in front of the cylinder block 3 and the pump housing 44 as well as it is possible to omit the governor case 514 in FIG. 11, it becomes possible to shorten the engine length in the fore and back direction by that as well as to reduce the manufacturing cost.

(9) Since it becomes unnecessary to dispose the fuel limiting member 147 within the timing transmission case 49, the thickness dimension of the case 49 can be made small, the engine length in the fore and back direction can be further shortened.

(10) Since the fuel limiting member 147 for stopping the governor lever 115 at the full load position D is adapted to be supported by the pump housing 44 outside the timing transmission case 49, the fuel limiting member 147 can be adjusted without removing the timing transmission case 49 so as to facilitate the adjusting work.

(11) Since it becomes unnecessary to pass the fuel limiting member 147 through the front wall of the pump housing 44, an oil sealing construction can be simple for preventing the scattered oils within the pump housing 44 from entering the timing transmission case 49. Therefore, the engine manufacturing cost can be further decreased.

Further, since the lubricating oil level check means 157 and the lubricating oil drain means 156 are arranged below the pump housing 44, an advantage of the following item (12) can be provided.

(12) Since the maintenance of the fuel injection pump 45, the confirmation of the lubricating oil quantity and the lubricating oil change can be carried out collectively from one lateral side of the engine, the engine maintenance becomes easy.

Furthermore, since the belt tension means 66 of the belt transmission device 62 for driving the engine attachments is disposed in the fore portion of the space on the lateral side of the cylinder head 8 and above the fuel injection pump 45 as well as the lubricating oil filter 151 is disposed in the back portion of the aforementioned space, advantages of the following items (13) through (16) can be provided.

(13) Since the pump housing 44, the belt tension means 66 and the filter 151 are collectively disposed in one lateral side of the engine body 2 so that they don't project on the other lateral side of the engine body 2, the transverse width of the engine body 2 can be shortened so as to allow the engine to be manufactured more compact.

(14) Since the maintenances of the fuel injection pump 45, of the belt tension means 66 and of the filter 151 can be collectively carried out from one lateral side, the maintenance of the engine 1 becomes much easier.

(15) Since the filter 151 is disposed at a comparatively high position of the engine body 2, it becomes possible to make an easy access to the filter 151 from a free space above the engine so as to facilitate the exchange of the filter.

(16) Since the filter 151 is disposed at a high position as mentioned above, the filter 151 doesn't obstruct a mounting work when the engine 1 is mounted to an engine working machine such as an engine generator and the like through a plurality of threaded holes 11 provided in the lower crankcase 6 so as to facilitate such a mounting work.

Further, since the dynamo 65 is connected to the tension pulley 67 of the aforementioned belt tension means 66, the construction for driving the dynamo 65 can be simplified. Since the transmission belt 68 is wrapped around the radiator fan 58, the engine cooling-liquid circulation pump 59 and the tension pulley 67, also the construction for driving the engine attachments such as the fan 58 and the like can be simplified. Accordingly, the engine manufacturing cost can be reduced and the engine maintenance becomes easy, too.

Incidentally, the above-mentioned embodiments of the present invention may be modified as described in the following items (a) through (e).

(a) The diesel engine may be of an air-cooled type instead of the liquid-cooled type as well as may have one cylinder or more than two cylinders. By the way, in the case of even-numbered cylinders, the injection pipes 48 may be symmetrically arranged in a short piping distance with ease.

(b) The upper crankcase and the lower crankcase may be integrated as one component member, and the integrated crankcase may be manufactured separately from the cylinder block.

(c) The pump housing, the filter, the respective drain means, the oil level check means and the like may be disposed on the left lateral side of the engine body.

(d) The governor lever and the governor spring may be of a single type.

(e) The centrifugal force transmission member of the mechanical governor may be composed of a solid rod instead of the sleeve. In the case of the solid rod, the transmission member is to be supported by the fuel injection camshaft through a holding member.

It will be apparent that, although a specific embodiment and certain modifications of the invention have been described in detail, the invention is not limited to the specifically illustrated and described constructions since variations may be made without departing from the principles of the invention.

What is claimed is:

1. A diesel engine with a mechanical governor, comprising:

a cylinder block having upper and lower portions, left and right lateral side portions and fore and back portions, a cylinder head fixedly secured onto said upper portion of the cylinder block, a crankshaft having a fore end portion and so disposed as to extend in the fore and back direction, a fuel injection pump unit provided with a pump housing having a fore and a back portion, a fuel injection pump having a fuel quantity adjusting means and a fuel injection camshaft having a front portion, a rear portion and a central portion, said pump housing being integrally formed one of said left and right lateral side portions of the cylinder block, said fuel injection pump and said fuel injection camshaft being disposed in the back portion of said pump housing, said front and rear portions of said fuel injection camshaft being rotatably supported at said fore and back portions of said pump housing respectively, a timing transmission case fixedly secured to the fore portions of said cylinder block and said pump housing, a timing transmission device disposed within said timing transmission case so as to interlockingly connect the fore end portion of the crankshaft to the fore end portion of the fuel injection camshaft, a mechanical governor having a governor lever, a governor spring, a governor weight and a transmission member for transmitting a centrifugal force of said governor weight, said governor weight and said centrifugal force transmission member being supported by said central portion of said fuel injection camshaft in the fore portion of said pump housing, said governor lever and said governor spring being disposed within said pump housing in such a condition as not entering said timing transmission case, and said governor spring and said governor weight being interlocked to the fuel quantity adjusting means of said fuel injection pump through the governor lever.

2. A diesel engine as set forth in claim 1, wherein said fuel injection pump is disposed substantially at the central portion of the cylinder block in the fore and back direction.

3. A diesel engine as set forth in claim 1, wherein said cylinder block is provided with a cylinder head receiving surface, and said pump housing is provided with an upper wall, a pump mounting bore and a pump receiving seat are formed in the upper wall of said pump housing, the upper surface of said pump receiving seat is formed substantially at the same level as the cylinder head receiving surface of said cylinder block, said fuel injection pump has a trunk portion and a mounting flange portion arranged in order from below, and said trunk portion is inserted into the pump housing through the pump mounting bore and said mounting flange portion is brought into contact with the upper surface of the pump receiving seat from above so as to be fixedly secured thereon.

4. A diesel engine as set forth in claims 2, wherein said cylinder block is provided with even-numbered cylinders.

5. A diesel engine as set forth in claim 4, wherein two cylinders are provided.

6. A diesel engine as set forth in claim 3, wherein said timing transmission device is constructed as a belt transmission type one, said governor lever is adapted to be stopped by means of a fuel limiting member at a full load position, and said fuel limiting member is passed through the pump housing outside the timing transmission case and is so supported thereby as to be adjustably advanced and retracted.

7. A diesel engine as set forth in claim 1 or claim 3, wherein a lubricating oil level check means and a lubricating oil drain means are arranged below said pump housing.

8. A diesel engine as set forth in claim 1 or claim 3, wherein a belt transmission device for driving an engine attachment is disposed in front of said timing transmission case and is interlockingly connected to the fore end portion of said crankshaft, a belt tension means is disposed in the fore portion of the space on the lateral side of the cylinder head and above the fuel injection pump, and a lubricating oil filter is disposed in the back portion of the space on the lateral side of the cylinder head and above the fuel injection pump.

9. A diesel engine as set forth in claim 8, wherein a dynamo is connected to a tension pulley of said belt tension means.

10. A diesel engine as set forth in claim 8. wherein said engine is of a liquid-cooled type, a radiator fan and an engine cooling-liquid circulation pump are arranged in the fore and back direction in front of said cylinder block, and said belt transmission device for driving the engine attachment comprises an output pulley fixedly secured to the fore end portion of the crankshaft, an input pulley fixedly secured to the radiator fan and the circulation pump, a tension pulley and a transmission belt wrapping around these pulleies.

11. A diesel engine as set forth in claim 1, further comprising:

a pump mounting bore and a pump receiving seat formed in an upper wall of said pump housing, said fuel injection pump having a trunk portion and a mounting flange portion arranged in order from below, said trunk portion being inserted into the pump housing through the pump mounting bore, and said mounting flange portion being brought into contact with the upper surface of the pump receiving seat from above so as to be fixedly secured thereon, a belt transmission device for driving an engine attachment, disposed in front of said timing transmission case and interlockingly connected to the fore end portion of said crankshaft, a belt tension means of said belt transmission device disposed in the fore portion of the space on the lateral side of the cylinder head and above the fuel injection pump, and a lubricating oil filter disposed in the back portion of the space of the lateral side of the cylinder head and above the fuel injection pump.

12. A diesel engine as set forth in claim 11, wherein a dynamo is connected to a tension pulley of said belt tension means.

13. A diesel engine as set forth in claim 11 or claim 12, wherein said engine is of a liquid-cooled type, a radiator fan and an engine cooling-liquid circulation pump are arranged in the fore and back direction in front of said cylinder block, and said belt transmission device for driving the engine attachment comprises an output pulley fixedly secured to the fore end portion of the crankshaft, an input pulley fixedly secured to the radiator fan and the circulation pump, a tension pulley and a transmission belt wrapping around these pulleys.

* * * * *